United States Patent [19]

Davis

[11] Patent Number: 4,862,811

[45] Date of Patent: Sep. 5, 1989

[54] SWIVELING, WALL-MOUNTED IRONING BOARD

[75] Inventor: Charles J. Davis, Green Valley, Ariz.

[73] Assignee: Uni-Cepts, Inc., Wichita, Kans.

[21] Appl. No.: 206,314

[22] Filed: Jun. 14, 1988

[51] Int. Cl.[4] ..... A47B 3/00

[52] U.S. Cl. ..... 108/134; 108/48

[58] Field of Search ..... 108/134, 33, 34, 35, 108/42, 48, 38; 38/103

[56] References Cited

U.S. PATENT DOCUMENTS

| | | | |
|---|---|---|---|
| Re. 18,223 | 10/1931 | Slawski . | |
| 158,844 | 1/1875 | Iske . | |
| 667,164 | 1/1901 | Carder | 108/48 X |
| 960,213 | 5/1910 | Williams | 108/48 |
| 1,136,878 | 4/1915 | Hornschuch . | |
| 1,402,929 | 1/1922 | Herpst et al. | 108/134 X |
| 1,506,240 | 8/1924 | Ives | 108/134 |
| 1,553,821 | 9/1925 | Johnson | 108/38 |
| 1,618,374 | 2/1927 | Faust . | |
| 1,631,255 | 6/1927 | Faust . | |
| 1,688,289 | 10/1928 | Slawski . | |
| 1,696,145 | 12/1928 | Wagoner . | |
| 2,014,549 | 9/1935 | Behm . | |
| 2,646,634 | 7/1953 | Mongar | 108/134 X |
| 2,658,294 | 11/1953 | Hull | 108/48 X |
| 3,451,360 | 6/1969 | Lemoyne | 108/34 |
| 3,965,588 | 6/1976 | Long . | |
| 4,480,556 | 11/1984 | Wilson et al. . | |

FOREIGN PATENT DOCUMENTS

| | | | |
|---|---|---|---|
| 1378 | of 1904 | United Kingdom | 108/48 |
| 396178 | 8/1933 | United Kingdom | 108/134 |
| 948429 | 12/1963 | United Kingdom | 108/134 |

*Primary Examiner*—Kenneth J. Dorner
*Assistant Examiner*—José V. Chen
*Attorney, Agent, or Firm*—Hovey, Williams, Timmons & Collins

[57] ABSTRACT

A wall-mounted ironing board swingable from an upright storage orientation to a horizontal use orientation is also pivotal about an upright axis to any one of a number of rotative positions once lowered to its horizontal orientation. The ironing board is carried therebeneath by an elongated support which extends substantially along the entire length of the board and which moves with the board during pivotal motion of the latter in a horizontal plane to the selected rotative position. The board is also shiftable along the length of the support toward either a retracted position or an extended position, and the inner end of the board when in the retracted position prevents pivotal motion of the board about the upright axis. An inclined brace extending upwardly from the wall cabinet is fixed to the support and is pivotal therewith as the board swings from one rotative orientation to another.

13 Claims, 2 Drawing Sheets

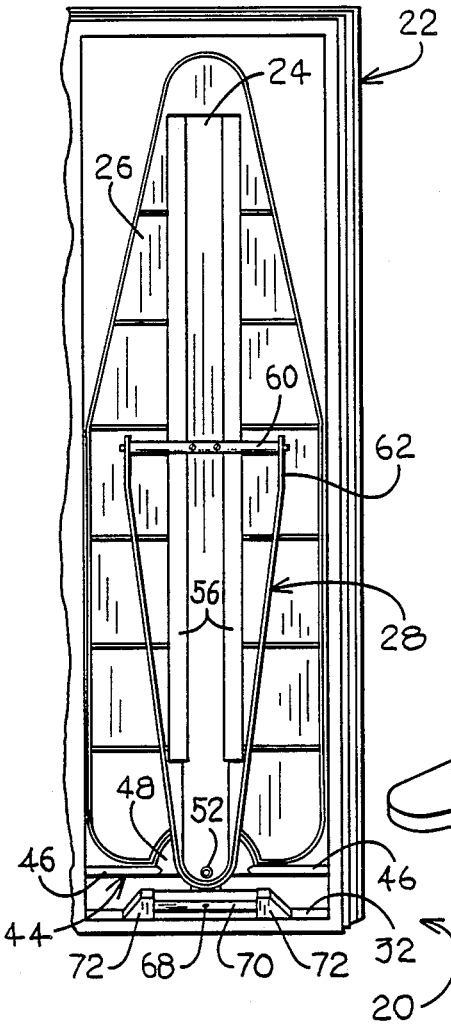
FIG. 2.
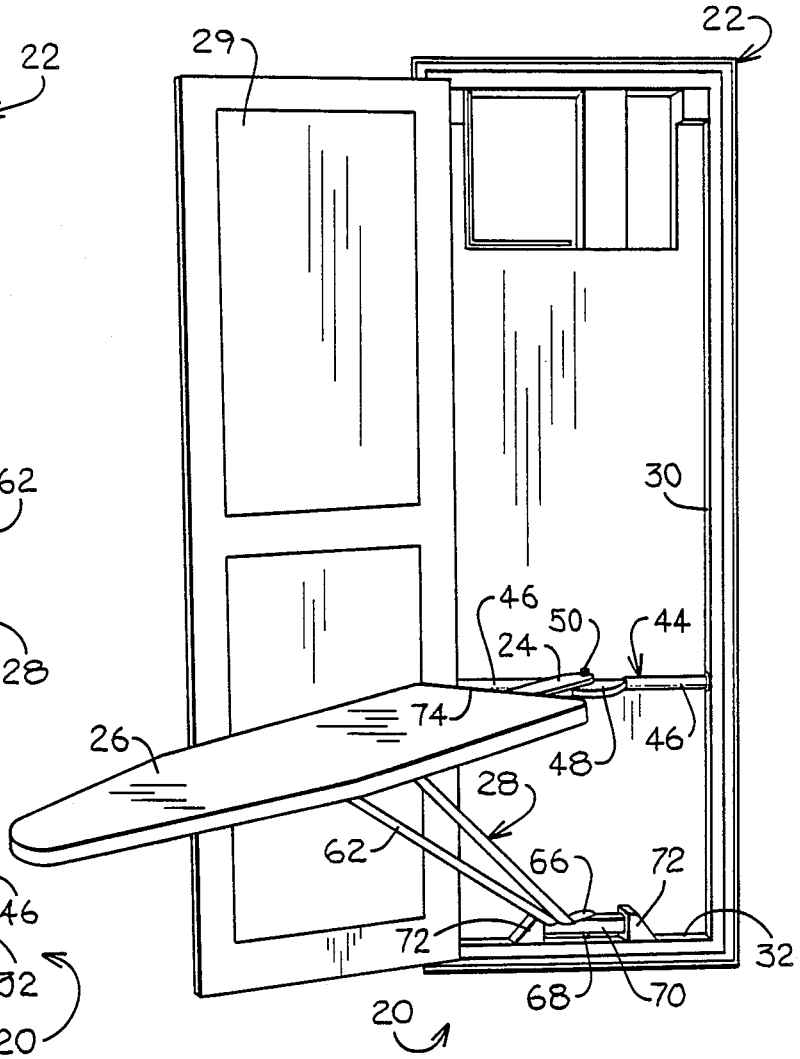
FIG. 1.
FIG. 3.
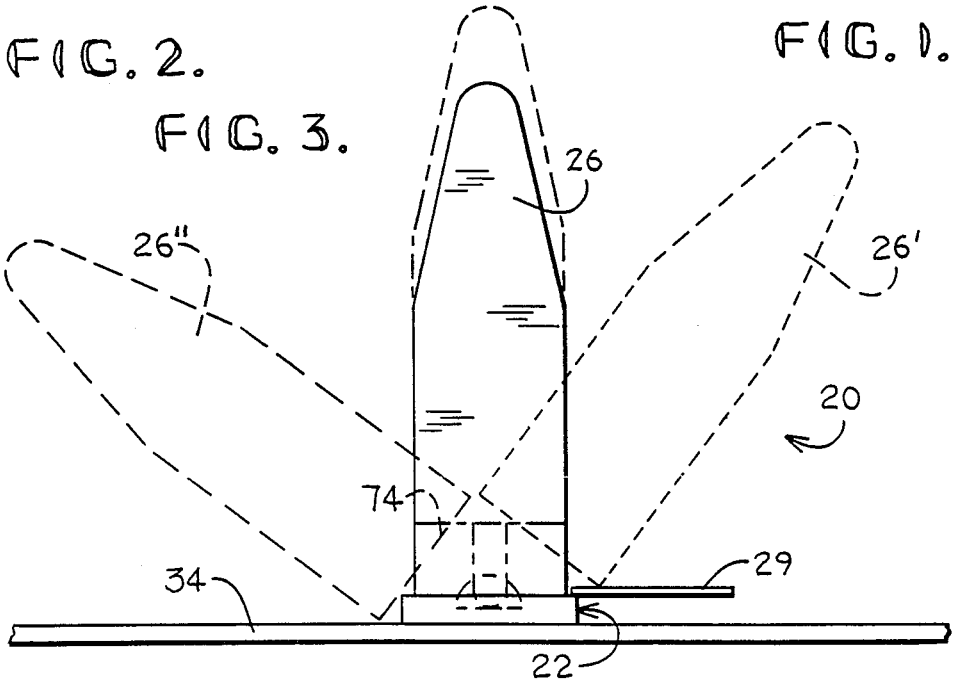

SWIVELING, WALL-MOUNTED IRONING BOARD

BACKGROUND OF THE INVENTION

1. Field of the Invention

This invention relates to an ironing board assembly that includes an ironing board swingable about a horizontal axis toward an upright storage position within a wall-mounted cabinet, and which is also pivotal about a vertical axis when the ironing board is lowered to a horizontal, use position.

2. Description of the Prior Art

In recent years, increased consumer interest has been directed toward wall-mounted ironing board assemblies that include an ironing board which is foldable to an upright position preferably within a wall cabinet for storage. Assemblies of this type are particularly useful in dwellings where space is limited and where a basement is not available for permanent placement of conventional, free-standing ironing boards. Moreover, the wall-mounted cabinets of ironing board assemblies can be finished to match substantially any room decor so that the user need not be relegated to a basement or laundry room away from activities of the family.

In the past, certain wall-mounted, foldable ironing board assemblies have been provided with pivot structure for selective movement of the board about a vertical axis toward different orientations to suit the convenience of the user. In this manner, the board can be positioned to view television or small children, or in some instances to facilitate access to the work operation. The following patents have been called to my attention as exemplary of such construction: U.S. Pat. Nos. 667,164, 1,618,374, 1,631,255, 1,684,034, 1,688,289, 1,696,145, 2,014,549, 2,658,294, and 4,480,556.

One problem which has long been associated with conventional foldable ironing boards is the lack of the sufficient support for the board to satisfactorily resist downward as well as lateral deflection of the board during use. At the same time, there is a demand for simplified construction using components that are relatively light in weight so that little effort is needed to fold the assembly for storage. Furthermore, it is desirable in the construction of wall-mounted ironing boards to avoid the use of outer legs which are foldable to engage the floor, and instead provide an underlying, inclined brace which extends back to the wall cabinet in order to maximize working clearances in regions beneath the board.

The wall-mounted ironing boards described in U.S. Pat. Nos. 667,164 and 2,014,549 are slidable in a horizontal direction to an extended position relative to a support pivotally connected to the wall cabinet, and such construction is useful for improving access to the board during use. However, inasmuch as the support illustrated in U.S. Pat. Nos. 667,164 and 2,014,549 pivots only about a horizontal axis when the board is folded for storage and does not swing about a vertical axis during pivotal movement of the board in a horizontal plane to different rotative positions, the support must be of relatively small size and can extend only a short distance beneath the inner end of the board, thereby providing relatively little resistance to deflection of the board's outer end. Instead, outer end portions of the ironing board shown in U.S. Pat. Nos. 667,164 and 2,014,549 are supported by a floor-engaging leg that drags along the floor during horizontal swinging of the board and which cannot be readily replaced by a simple, inclined brace without adversely affecting extension or retraction of the board along horizontal planes toward and away from the cabinet.

SUMMARY OF THE INVENTION

My present invention overcomes the above-noted problems long associated with conventional construction by provision of an ironing board assembly having an ironing board that may be folded to an upright, storage orientation within a cabinet, that may be extended in a horizontal direction away from the cabinet when lowered to an unfolded, use orientation, and which may also be pivoted about an upright axis as desired to facilitate access to the work operation. Moreover, an inclined brace extending beneath the board to the cabinet is spaced from the floor and extends back to the cabinet and does not require handling or attention by the user regardless of whether the board is moved about a horizontal axis between the storage orientation and the use orientation, pivoted about the vertical axis toward a selected rotative position or extended or retracted along a straight line toward and away from the cabinet.

In accordance with the invention, the assembly includes an elongated support which extends along substantially the entire length of the board. The support is slidably coupled to the ironing board, and an upper end portion of the brace is pivotally coupled to a mid-portion of the support. The support is connected to the wall cabinet by a pivot which enables the support to swing with the board during rotational movement of the board in a horizontal plane and consequently the support is operable to satisfactorily resist vertical deflection of the board regardless of whether downward forces are imposed on the inner, mid-section or outer end of the board.

In preferred embodiments of my invention, the support is coupled to the frame of the wall cabinet by means of elongated rods having outer end portions that are each received in slots formed within the cabinet frame. The board has an inner end which comes into direct, abutting contact with the rods when the board is shifted along the support to its retracted position. The inner end of the board precludes pivotal motion of the board toward different rotative orientations until such time as the board has been extended to shift its inner end away from the rods. Further, the provision of direct engagement between the retracted board and the rods substantially reduce the effective height of the cabinet needed to house a board of a particular length.

These and other aspects of the invention are further explained in the detailed description of a preferred embodiment of my invention which follows:

BRIEF DESCRIPTION OF THE DRAWINGS

FIG. 1 is a perspective view showing the front of an ironing board assembly that is constructed in accordance with the principles of my present invention, wherein an ironing board of the assembly has been lowered and shifted to one of many possible orientations for use;

FIG. 2 is fragmentary, front elevational view of the assembly illustrated in FIG. 1 except that the ironing board has been shifted to an upright, storage orientation within a wall-mounted cabinet of the assembly;

FIG. 3 is a reduced, plan view of the assembly shown in FIG. 1, wherein the dashed lines indicate three possible rotative positions of the board once the latter is extended;

DETAILED DESCRIPTION OF THE DRAWINGS

Figure 4:
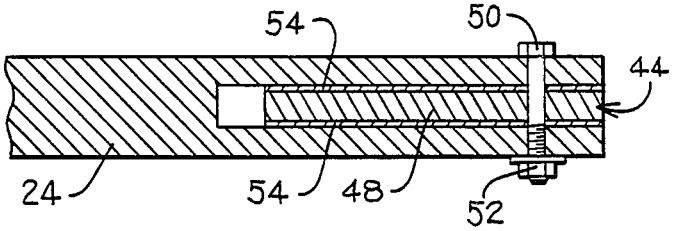
FIG. 4 is an enlarged, fragmentary, side cross-sectional view of the assembly of FIGS. 1 and 2, depicting a pivotal connection between an elongated support which carries the board and a pivotal interconnection element coupled to sidewalls of the cabinet frame.
Figure 5:
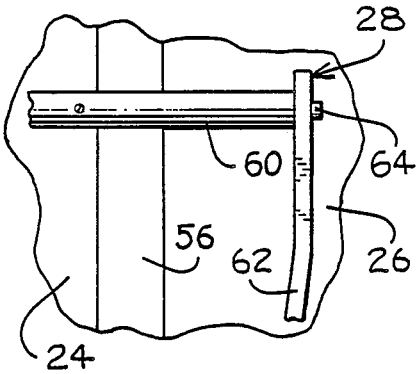
FIG. 5 is an enlarged, fragmentary, bottom view of a pivotal connection between the support and a brace which is also shown in FIGS. 1 and 2.

An ironing board assembly 20 that is constructed in accordance with a preferred embodiment of my invention is illustrated in FIGS. 1–9. The assembly 20 includes, in broad terms, a wall-mounted cabinet 22, an elongated support 24 (see, e.g., FIGS. 2, 6, 7, and 9) and an ironing board 26 carried by support 24. An inclined brace 28 extends from a mid-portion of the support 24 toward a lower portion of the cabinet 22.

In more detail, the cabinet 22 includes a door 29 (FIGS. 1 and 9) swingable about a vertical axis from positions closing and opening the cabinet 22. Upright sidewalls 30, a bottom wall 32, and a top wall (not numbered) constitute structure defining a cabinet frame. The cabinet 22 is surface mounted on a vertical wall 34 (FIG. 3) of a dwelling, although it is of course possible in this regard to flush mount the cabinet 22 in a recess within a wall as may be desired, preferably in combination with appropriate trim.

Figure 6:
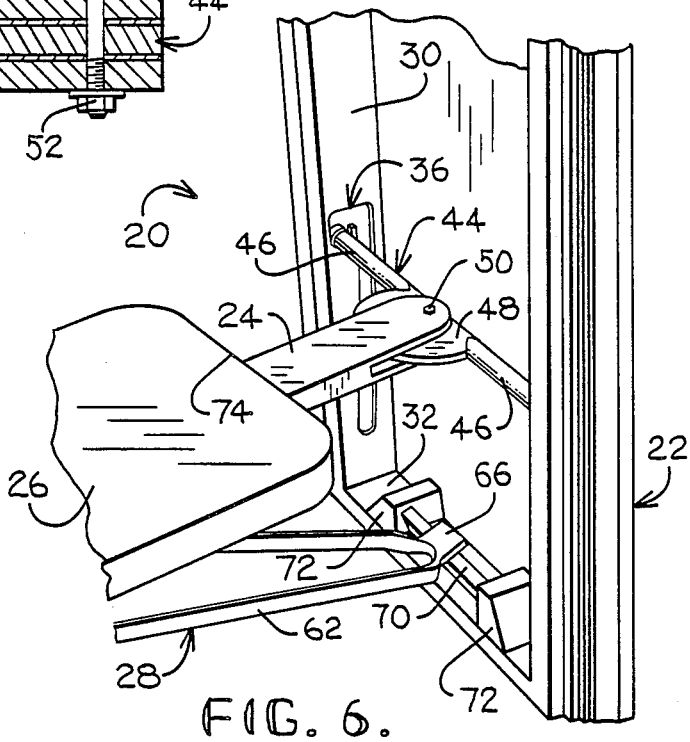
FIG. 6 is an enlarged, perspective, fragmentary view of a portion of the ironing board and cabinet illustrated in FIGS. 1–4, showing among other things one of two slots formed in the cabinet walls which receive rod-like ends of the pivotal interconnection element.
Figure 8:
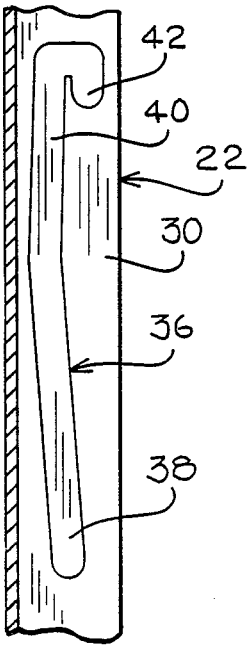
FIG. 8 is an enlarged, fragmentary, side cross-sectional view of one of the two slots formed in the cabinet sidewall which is also shown in FIG. 6.
Figure 7:
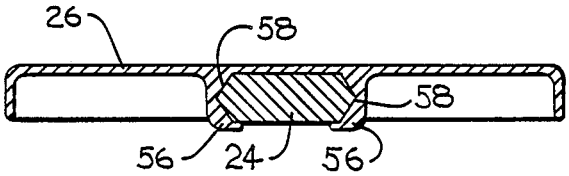
FIG. 7 is enlarged, end cross-sectional view of the ironing board and the support of FIGS. 1 and 6, depicting a channel formed beneath the board to receive the support.

Each of the opposed sidewalls 30 of cabinet 22 is formed to present a slot 36 that can be appreciated by reference to FIGS. 6 and 8. Each slot 36 has a generally overall, inverted J-shaped configuration, the majority of which is in the form of a dog leg having a lower segment 38 (FIG. 8) inclined in one direction from vertical, and an upper segment 40 inclined in an opposite direction from vertical at an angle less than the angle of inclination of the lower segment 38. The upper end of the slot 36 includes a short, depending nook 42.

Figure 9:
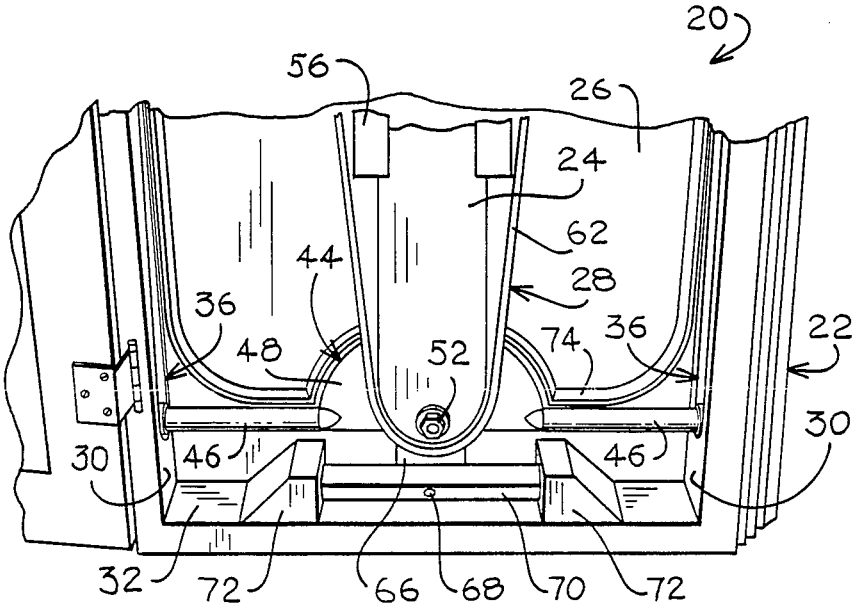
FIG. 9 is an enlarged, fragmentary, perspective view of a lower portion of the assembly depicted in FIG. 2.

A means connecting the support 24 to the frame or sidewalls 30 of the cabinet 22 includes a pivotal interconnection element 44 that is illustrated, for example, in FIGS. 6 and 9. The pivotal interconnection element 44 includes a pair of rods 46 which extend away from each other in opposite, horizontal directions and the outer end of each rod 46 is capped and received within a respective one of the slots 36 of cabinet 22. A generally flat, semi-circular plate 48 interconnects the rods 46.

The inner end of the support 24 is bifurcated and thus presents a slot which receives the semi-cylindrical plate 48 of the interconnection element 44. Viewing FIG. 4, a vertical bolt 50 extends through aligned holes in the bifurcated end of the support 24 as well as a hole in the plate 48 in order to pivotally couple the inner end of the support 24 to the interconnection element 44 for movement about an axis coincident with the longitudinal axis of bolt 50.

The bolt 50 is secured in place by a washer and nut 52 as illustrated in FIG. 4. In addition, interior surfaces of the bifurcated end of the support 24 each carry a length of material such as brake lining 54 which is also in contact with adjacent regions of the plate 48 for providing some degree of resistance to swinging motion of the support 24 relative to plate 48 about the longitudinal axis of bolt 50.

As can be appreciated by reference to FIG. 2, the support 24 extends substantially along the entire length of the ironing board 26. A pair of depending walls 56 (FIG. 7) are integrally formed with the ironing board 26 and are spaced apart from each other a distance to define a channel which slidably receives the support 24 in order to permit selective, horizontal shifting movement of the board 26 relative to the support 24 toward either a retracted position directly adjacent the cabinet 22 as shown by the full line depiction in FIG. 3 and an extended position which is shown by the central dashed line depiction in the same drawing.

Preferably, the support 24 is formed to present opposed, somewhat V-shaped sidewalls 58 which are complemental in configuration with inner, facing surfaces of the walls 56 defining the channel, in order to promote sliding of the board 26 relative to the support 24 while keeping the support 24 within the channel between walls 56. However, the V-shaped walls 58 terminate at approximately the same location as the inner end of the channel defining walls 56 when the board 26 is in its retracted position, and the remaining, inner end of the support 24 instead is provided with flat, parallel sidewalls which can be viewed by reference to FIG. 6.

An upper end portion of the brace 28 includes an elongated bar 60 that is secured by screws to a mid-portion of the support 24. The brace 28 is also comprised of a generally U-shaped strut 62 pivotally connected to the bar 60 for swinging movement about the longitudinal axis of the latter. Viewing FIG. 5, each end of the bar 60 is formed to present a reduced diameter cylindrical section 64 which extends through a mating hole formed in an upper portion of each leg of the strut 62 in order to permit pivotal movement of the strut 62 relative to bar 60.

A lower region, or bight region of the strut 62 includes a flat segment 66 (FIGS. 6 and 9) that is coupled by means of a pivot 68 (FIG. 9) to an elongated body 70, and the pivot 68 is in vertical alignment with the bolt 50 when the ironing board 26 is unfolded to a use orientation such as is shown in FIGS. 1 and 6. The body 70, on the other hand, is pivotally mounted on opposite ends by a pair of blocks 72 fixed to the bottom wall 32 of the cabinet 22, and the blocks 72 support the body 70 for rotative movement about the longitudinal axis of the latter when the ironing board 26 is shifted toward either the use orientation shown in FIGS. 1 and 6 or an upright, storage orientation which is shown in FIGS. 2 and 9.

As, for example, the ironing board 26 is lowered toward its use orientation, the rods 46 turn about their longitudinal axis while advancing along the length of the slots 36 at the same time that body 70 turns about its longitudinal axis so that the strut 62 moves from a vertical orientation adjacent the support 24 as shown in FIG. 2 to an inclined orientation away from the support 24 as depicted in FIG. 1. Once the outer end of each rod 46 has moved into the nook 42 of the respective slot 36, the rods 46 generally thereafter stay in the nooks 42 until such time as the user lifts the interconnection element 44 in order to raise the board 26 to its folded or upright storage orientation. Advantageously, the nooks 42 are of a depth greater than at least one-half of the diameter of rods 46 to retain the latter in place until manually uplifted. The dog leg between the lower segment 38 and the upper segment 40 of each slot 36 provides substantially non-binding movement of the rods 46 during raising or lowering of the board 26.

After the board 26 is lowered, the user normally extends the board 26 away from the cabinet 22 in order to facilitate access to the ironing operation. As the board 26 is shifted away from the cabinet 22, an inner end 74 of the board 26 moves away from the rods 46 of the interconnection element 44 to thereby provide clearance and enable the board 26 and the support 24 to be simultaneously pivoted in a horizontal plane about bolt 50 and pivot 68 to a selected rotative orientation. In FIG. 3, the numerals 26', 26'' indicate the extremes of possible rotative orientations.

It can now be appreciated that the use of rods 46 is particularly advantageous in that the overall height of cabinet 22 can be minimized within practical limits for a given length of ironing board 26. Certain of the prior art ironing board assemblies, by contrast, are provided with a flat, relatively wide pivotal support which in turn required the use of a cabinet of corresponding greater height.

The support 24, being pivotally connected by bolt 50 to the interconnection element 44, can be of substantial length and is preferably, as depicted in the drawings, of a dimension substantially equal to the length of the ironing board 26. As a consequence, the support 24 provides support for the board 26 along substantially the entire length of the latter in order to resist undue downward deflection during use of the assembly 20 without out the need for providing extensive bracing on the underside of board 26. The brace 28, being connected to the support 24 instead of board 26, provides rigidity to the assembly 20 regardless of whether or not the board 26 is extended or retracted.

It is understood that those skilled in the art may make various modifications or additions to the currently preferred embodiment of my invention that is illustrated in the drawings without departing from the essence of my contribution to the art. For example, the transverse bar 60 and the support 24 may be integrally formed, possibly of synthetic resinous materials. Many other variations are also possible. Consequently, the invention should be deemed limited only by a fair scope of the claims which follow along with their mechanical equivalents.

I claim:

1. An ironing board assembly comprising:

structure defining a frame positioned in a first plane;

an elongated support;

means for connecting said support to said frame for selective movement of said support relative to said frame between an upright storage orientation substantially parallel to said first plane and a substantially horizontal use orientation positioned in a second plane, which is substantially perpendicular to said first plane;

an elongated ironing board; and means for connecting said ironing board to said support for selective longitudinal movement of said board along said second plane, when said support is in said horizontal use orientation, between an extended position remote from said frame and a retracted position adjacent said frame, said means for connecting said support to said frame defining structure including pivot means for providing selective, pivotal movement of said support and said ironing board relative to said frame about an upright axis.

2. The invention as set forth in claim 1, wherein said support extends substantially along the length of said ironing board.

3. The invention as set forth in claim 1, further including means for precluding pivotal movement of said support when said ironing board is in said retracted position.

4. The invention as set forth in claim 1, further including a brace having an upper end portion connected to said support and a lower end portion pivotally coupled to said frame.

5. The invention as set forth in claim 1, wherein said means for connecting said support to said frame includes means for permitting selective, swinging motion of said support and of said ironing board therewith about a generally horizontal axis between said upright, storage orientation and said substantially horizontal, use orientation.

6. The invention as set forth in claim 5, further including a brace having an upper end portion connected to said support and a lower end portion connected to said frame, said lower end portion of said brace being pivotal about a generally horizontal axis during swinging movement of said support and said ironing board therewith to either said upright orientation or said generally horizontal orientation.

7. The invention as set forth in claim 1, wherein said means for connecting said ironing board to said support includes walls coupled to said ironing board and defining a channel, said support being slidably received in said channel.

8. The invention as set forth in claim 1, wherein said frame includes a pair of opposed slots, said means for connecting said support to said frame including elongated rod sections having end portion each received in a selective one of said slots.

9. The invention as set forth in claim 8, wherein said ironing board presents an inner end section disposed in direct, abutting contact with said rod sections when said ironing board is in said retracted position for substantially precluding movement of said ironing board and said support about said upright axis.

10. An ironing board assembly comprising:

structure defining an upright wall positioned in a first plane including a slot;

an elongated rod having an outer end portion movably received in said slot;

an ironing board;

means for coupling said ironing board to said rod for selective movement in the longitudinal direction of the board along a second plane substantially perpendicular to said first plane between an extended position spaced from said rod and a retracted position directly adjacent said rod, said rod during movement along said slot being swingable about a generally horizontal axis for enabling swinging motion of said ironing board between an upright storage orientation, which is substantially parallel to said first plane, and a substantially horizontal, use orientation which is substantially parallel to said second plane, said means coupling said ironing board to said rod including means for enabling selective, pivotal movement of said ironing board relative to said structure defining an upright wall about an upright axis, said ironing board including an inner end section disposed in direct, abutting contact with said rod when said ironing board is in said retracted position for substantially precluding movement of said ironing board at least in one direction about said upright axis.

11. The invention as set forth in claim 10, wherein said means for coupling said ironing board to said rod includes an elongated support pivotally coupled to said rod and shiftably connected to said ironing board.

12. The invention as set forth in claim 11, wherein said ironing board is elongated and said support extends substantially the entire length of said board.

13. The invention as set forth in claim 10, further including a brace having an upper end portion pivotally connected to said support and a lower end portion pivotally connected to said structure defining an upright wall.

* * * * *